US011802445B2

(12) United States Patent
Golinowski

(10) Patent No.: US 11,802,445 B2
(45) Date of Patent: Oct. 31, 2023

(54) CABLE HEAD FOR ATTACHING A DOWNHOLE TOOL TO A WIRELINE

(71) Applicant: TIER 1 ENERGY TECH, INC., Edmonton (CA)

(72) Inventor: Jeffrey Golinowski, Sherwood Park (CA)

(73) Assignee: Tier 1 Energy Solutions, Inc., Edmonton (CA)

( * ) Notice: Subject to any disclaimer, the term of this patent is extended or adjusted under 35 U.S.C. 154(b) by 0 days.

(21) Appl. No.: 17/742,634

(22) Filed: May 12, 2022

(65) Prior Publication Data

US 2022/0268107 A1 Aug. 25, 2022

Related U.S. Application Data

(62) Division of application No. 16/998,788, filed on Aug. 20, 2020, now Pat. No. 11,359,440.

(60) Provisional application No. 62/889,657, filed on Aug. 21, 2019.

(51) Int. Cl.
*E21B 17/02* (2006.01)

(52) U.S. Cl.
CPC ..... *E21B 17/023* (2013.01)

(58) Field of Classification Search
CPC ..... E21B 17/023; E21B 17/026; H01B 7/046
See application file for complete search history.

(56) References Cited

U.S. PATENT DOCUMENTS

| | | | | |
|---|---|---|---|---|
| 2,847,075 | A | 8/1958 | Halbrook et al. | |
| 2,944,603 | A | 7/1960 | Baker et al. | |
| 3,001,802 | A | 9/1961 | Rebman et al. | |
| RE26,458 | E | 9/1968 | Moore | |
| 4,063,592 | A | 12/1977 | Youmans | |
| 4,295,528 | A | 10/1981 | Carmody | |
| 4,697,641 | A * | 10/1987 | White | E21B 17/028 166/243 |
| 5,765,641 | A | 6/1998 | Shy et al. | |
| 5,826,661 | A | 10/1998 | Parker et al. | |
| 6,026,903 | A | 2/2000 | Shy et al. | |
| 6,032,733 | A * | 3/2000 | Ludwig | E21B 17/06 166/385 |
| 6,196,325 | B1 * | 3/2001 | Connell | E21B 17/206 166/242.6 |

(Continued)

*Primary Examiner* — David Carroll
(74) *Attorney, Agent, or Firm* — Bennett Jones LLP

(57) ABSTRACT

A cable head for attaching a wireline to a downhole tool includes an upper tubular member and a lower tubular member removably attached by a threaded connection. The cable head includes a pack-off assembly disposed within the upper tubular member. The pack-off assembly includes a deformable pack-off element comprising an outer sidewall for sealing against an inner sidewall of the upper tubular member, and an inner sidewall for sealing around the wireline. The pack-off assembly includes a biasing means axially in line with the deformable pack-off element. The pack-off element and the biasing means are axially compressed between an internal shoulder of the upper tubular member and the lower tubular member when the upper and lower tubular members are removably attached by the threaded connection, to enhance the seal of the tubular pack-off element with the inner sidewall of the upper tubular member, and with the wireline.

7 Claims, 2 Drawing Sheets

(56) References Cited

U.S. PATENT DOCUMENTS

| | | | | |
|---|---|---|---|---|
| 6,431,269 | B1 * | 8/2002 | Post | E21B 17/023 166/242.7 |
| 6,505,685 | B1 | 1/2003 | Sullaway et al. | |
| 7,343,979 | B2 * | 3/2008 | Dreggevik | E21B 17/023 166/57 |
| 7,363,985 | B2 * | 4/2008 | Heinonen | E21B 34/10 166/242.6 |
| 9,033,055 | B2 | 5/2015 | Mccoy et al. | |
| 9,441,446 | B2 | 9/2016 | Fripp et al. | |
| 10,323,478 | B2 | 6/2019 | Berscheidt et al. | |
| 10,808,490 | B2 | 10/2020 | Giroux | |
| 10,883,315 | B2 | 1/2021 | Getzlaf et al. | |
| 2010/0326661 | A1 | 12/2010 | Khomynets | |
| 2016/0060967 | A1 * | 3/2016 | Varkey | E21B 17/028 166/243 |
| 2017/0167204 | A1 * | 6/2017 | Drenth | E21B 17/05 |
| 2019/0128081 | A1 | 5/2019 | Ross et al. | |
| 2020/0217148 | A1 * | 7/2020 | Massey | E21B 17/028 |

* cited by examiner

CABLE HEAD FOR ATTACHING A DOWNHOLE TOOL TO A WIRELINE

CROSS REFERENCE TO RELATED APPLICATIONS

This application claims the priority benefit of U.S. Provisional Patent Application No. 62/889,657, filed Aug. 21, 2019, entitled Cable Head For Attaching A Downhole Tool To A Wireline, the entire contents of which are incorporated herein by reference.

FIELD OF THE INVENTION

The present invention relates to a cable head for attaching a downhole tool to a wireline.

BACKGROUND OF THE INVENTION

An acid pump-down perforation operation may be used to stimulate an oil and gas producing formation. The operation involves pumping a wireline-deployed downhole plug and perforating tool into a stage of a wellbore adjacent to the formation to be stimulated. A bridge plug is set to isolate the stage of the wellbore and then a perforating gun is activated to perforate the formation. Acid is then pumped into the wellbore and through the perforations to stimulate the formation. During acid pumping, the downhole tool may remain in the wellbore, however, the wireline must be protected from acid exposure by a jacket or coating. This process may be performed at multiple stages of the wellbore by moving the tool uphole to a different location and repeating the process described above.

The uphole end of the plug and perforating tool includes a cable head for securing the wireline to the tool. The cable head conventionally includes a tubular member having an internal anchoring device. To secure the wireline to the downhole tool, the steel strands of the wireline are exposed, unbraided from each other, and secured to the internal anchoring device of the cable head. The cable head includes an internal tubular pack-off element that seals around the jacketed portion of the wireline, and protects the internal anchoring device and exposed steel strands of the wireline from acid exposure.

The integrity of the seal created by the tubular pack-off element is critical to reliability of the attachment of the wireline to the downhole tool. Accordingly, there is a need in the art to improve the integrity of this seal.

SUMMARY OF THE INVENTION

In one aspect, the present invention comprises a cable head for attaching a wireline to a downhole tool. The cable head includes an upper tubular member and a lower tubular member removably attached by a threaded connection. The cable head includes a pack-off assembly disposed within the upper tubular member. The pack-off assembly includes a deformable pack-off element, which may preferably be an elastomeric material. The pack-off element comprises an outer sidewall for sealing against an inner sidewall of the upper tubular member, and an inner sidewall for sealing around the wireline. The pack-off assembly also includes a biasing means, such as a spring, axially in line with the deformable pack-off element. The tubular pack-off element and the biasing means are axially compressed between an internal shoulder of the upper tubular member and the lower tubular member when the upper and lower tubular members are connected together.

In another aspect, the invention comprises a method of attaching a wireline to a downhole tool, said method comprising the steps of:

(a) passing the wireline through a cable head comprising an internal deformable seal;
(b) deforming the seal to isolate an upper portion of the cable head from a lower portion of the cable head; and
(c) attaching the wireline to an anchoring device disposed in the lower portion of the cable head.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

The invention relates to a cable head for attaching a wireline to a downhole tool. Any term or expression not expressly defined herein shall have its commonly accepted definition understood by a person skilled in the art.

Figure 1:
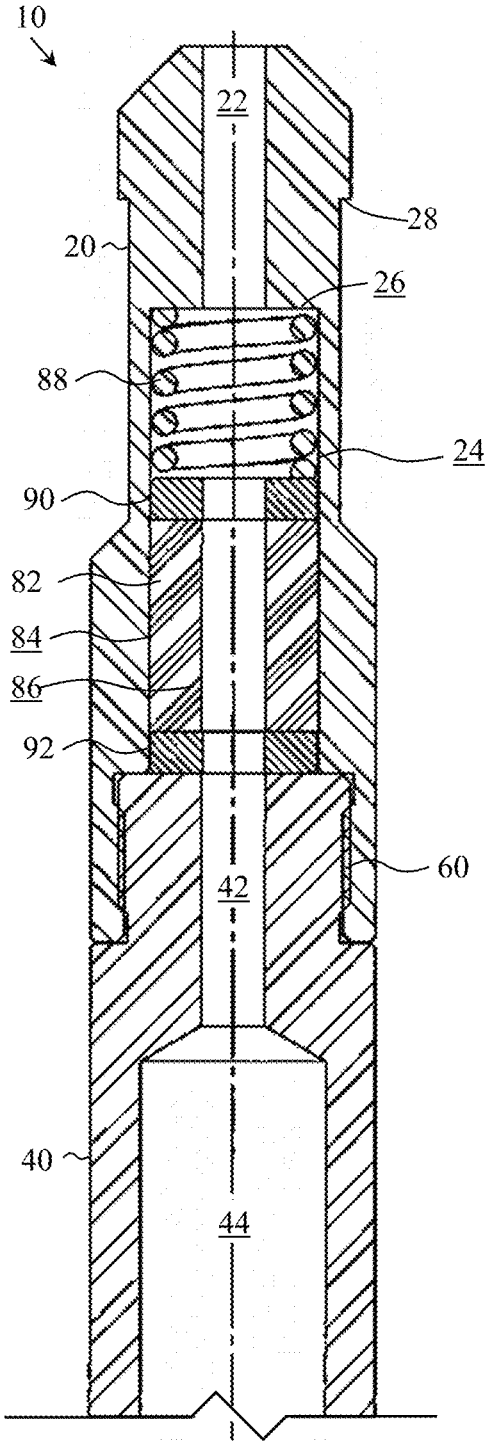
FIG. 1 shows a longitudinal midline cross-sectional view of an embodiment of a cable head of the present invention.

Referring to FIG. 1, one embodiment of the cable head (10) includes an upper tubular member (20) and a lower tubular member (40) removably attached by a threaded connection (60). In the embodiment of FIG. 1, for example, the lower end of the upper tubular member (20) define a threaded box-and-pin joint. The tubular members (20, 40) may be made of materials, such as steel alloys, suitable for withstanding conditions expected to be encountered in a downhole environment, including acid exposure.

The upper tubular member (20) defines an axial bore. As used herein, the terms "axial" or "longitudinal" refer to the direction that is substantially parallel to the central axis along the length of the tubular member (20), while the terms "radial" or "transverse" refer to a direction that is perpendicular to the "axial" or "longitudinal" direction. An upper portion (22) of the axial bore has an inner diameter sized to permit through passage of a wireline. The lower portion (24) of the axial bore has an enlarged inner diameter sized to house a pack-off assembly (80). The transition between the upper portion (22) and the lower portion (24) of the axial bore forms an internal shoulder (26), which provides an annular bearing surface for the pack-off assembly (80). The upper tubular member (20) also defines an external fishing-neck profile (28) for engagement by a fishing tool, which can be used to retrieve the cable head (10) in the event that the attachment of the wireline is compromised, or the cable head (10) is stuck in a wellbore.

The lower tubular member (40) also defines an axial bore. An upper portion (42) of the axial bore has an inner diameter sized to permit through passage of the wireline. A lower portion (44) of the axial bore has an enlarged inner diameter sized to house an anchoring device (not shown) for securing the wireline to the cable head (10). The present invention is not limited by any particular type of anchoring device, or any particular manner of attachment of the anchoring device to the wireline. Suitable anchoring devices are known in the art. A non-limiting example of a suitable anchoring device is available from OSS Oilfield Equipment Ltd. (Edmonton, Canada), and includes a conical member that separates the unbraided steel strands of the wireline, and a cap that crimps the strands against the conical member when the cap is screwed onto the conical member. In use, the lower end (not shown) of the lower tubular member (40) is connected to additional components (not shown) of a downhole tool (e.g., a perforating gun, and a bridge plug) using suitable connection means known in the art (e.g., a threaded box-and-pin joint).

Figure 2:
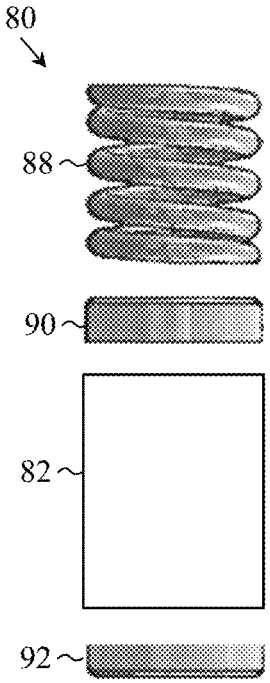
FIG. 2 shows an exploded view of the embodiment of the pack-off assembly of the cable head of FIG. 1.

The cable head (10) includes a pack-off assembly (80) disposed within the upper tubular member (20). In the embodiment of FIGS. 1 and 2, the pack-off assembly (80) includes a deformable tubular pack-off element (82), a biasing means such as a spring (88), an upper annular bushing (90), and a lower annular bushing (92).

The tubular pack-off element (82) is made of a deformable material that results in an outer sidewall (84) of the pack-off element (82) expanding radially outward to seal against the inner sidewall of the upper tubular member (20), and an inner sidewall (86) of the pack-off element (82) contracting radially inward to seal against the wireline, due to the radial expansion of the material in response to axial compression.

In one embodiment, the deformable material is preferably a resilient material, preferably an elastomeric material such as a natural or synthetic rubber or a polymer, which allows the tubular pack-off element (82) to return towards is original shape and dimensions when the pack-off element (82) is axially unloaded. This may allow the pack-off element (82) to be re-used after the cable head (10) is disassembled. Suitable polymers are well known in the art, and include polyurethanes.

In other embodiments, the deformable material may not be an elastomeric material, and may therefore permanently deform when axially compressed. In one embodiment, the deformable material may be a material which is resistant to damage from acid exposure. As noted, the outer sidewall (84) is for sealing against an inner sidewall that defines the lower portion (24) of the axial bore of the upper tubular member (20). Accordingly, the outer diameter of the tubular pack-off element (82) should closely match the inner diameter of the lower portion (24) of the axial bore of the upper tubular member (20). As noted, the inner sidewall (86) is for sealing around the wireline. Accordingly, the inner diameter of the tubular pack-off element (82) should closely match the outer diameter of the wireline. In the embodiment of FIGS. 1 and 2, the tubular pack-off element (82) has a substantially cylindrical shape, with a flat upper annular surface, and a flat lower annular surface.

The spring (88) may be made of a material, such as a steel alloy, suitable for withstanding conditions expected to be encountered in a downhole environment, including acid exposure. In the embodiment of FIGS. 1 and 2, the spring (88) is a coil spring, which permits through passage of the wireline. In another embodiment (not shown), the spring may be a Belleville spring (also known as a Belleville washer, or a coned-disc spring), which is in the form of an annular disc, with a frusto-conical shape in its axial cross-section. In other embodiments (not shown), the spring (88) may be another type of compression spring that axially shortens in response to an applied compressive load. The spring (88) is axially in line with the tubular pack-off element (82).

The bushings (90, 92) allow for more uniform application of axial compressive forces to the tubular pack-off element (82). The bushings (90, 92) may be made of materials, such as steel alloys, or engineering thermoplastic materials such as polyether ether ketone (PEEK), suitable for withstanding conditions expected to be encountered in a downhole environment, including acid exposure. In some embodiments, the spring (88) is disposed above the tubular pack-off element (82), with the upper end of the spring (88) abutting the internal shoulder (26) of the upper tubular member (20). Accordingly, the upper annular bushing (90) is disposed between and in abutting relationship with the lower end of the spring (88) and the upper end of the tubular pack-off element (82), while the lower annular bushing (92) is disposed between and in abutting relationship with the lower end of the tubular pack-off element (82) and the upper end of the lower tubular member (40). In other embodiments (not shown), the tubular pack-off element (82) may be disposed above the spring (88), with the lower end of the spring (88) abutting the upper end of the lower tubular member (40). In other embodiments, the bushings (90, 92) are optional, and may not be present, in which case the lower end of the spring (88) and the upper end of the pack-off element (82) may be in direct abutting relationship with each other, while the lower end of the pack-off element (82) and the upper end of the lower tubular member (40) may be in direct abutting relationship with each other. If the bushings (90, 92) are omitted, then it will be appreciated that the length of the axial bore (24), the pack-off element (82), and/or the spring (88), and/or the mechanical properties of the pack-off element (82) and/or the spring (88) may need to be varied so that the spring (88) imparts a desired amount of compression to the pack-off element (82).

In order to assemble the cable head (10) as shown in FIG. 1, the upper tubular member (20) and the lower tubular member (40) are initially separated from each other. The components of the pack-off assembly (80) are placed inside the lower portion (24) of the axial bore of the upper tubular member (20). The lower end of a wireline (not shown) is inserted through the axial bore of the upper tubular member (20), the components of the pack-off assembly (80), and the axial bore of the lower tubular member (40). The lower end of wireline is securely attached to an anchoring device (not shown). The anchoring device is placed in the lower portion (44) of the axial bore of the lower tubular member (40). Additional components of a downhole tool (e.g., a perforating gun, and a bridge plug) are attached to the lower end of the lower tubular member (40), thereby enclosing the anchoring device in the axial bore of the lower tubular member (40).

Figure 3:
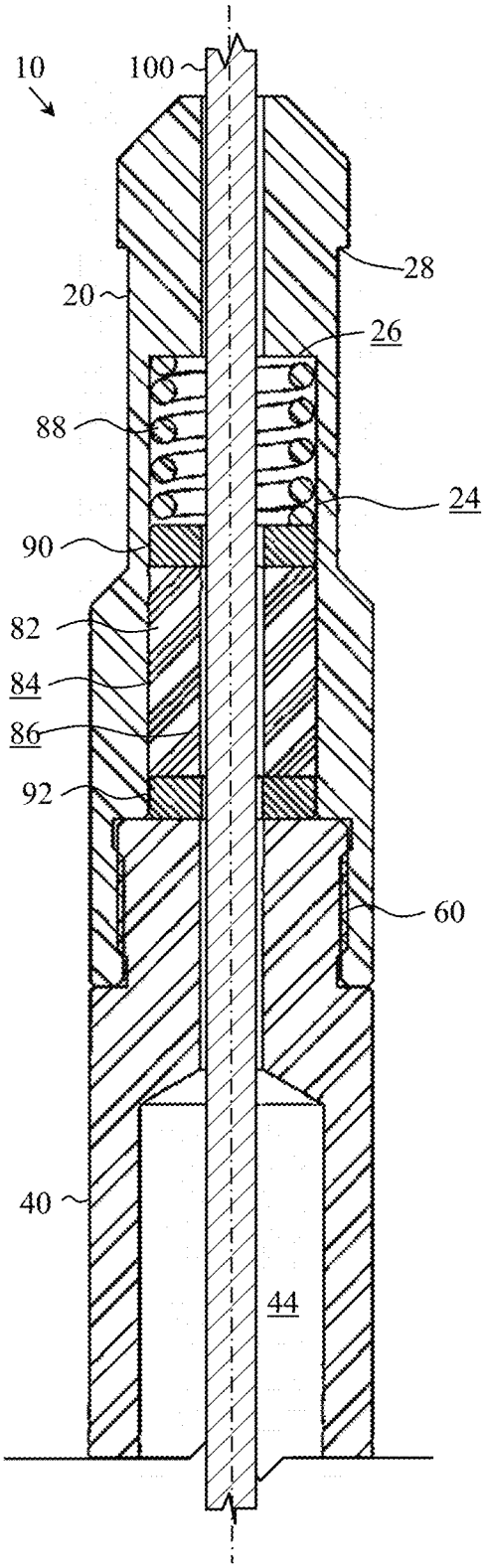
FIG. 3 shows a longitudinal midline cross-sectional view of the cable head of FIG. 1, with a portion of a wireline passing through it.

The upper tubular member (20) is screwed onto the lower tubular member (40) so that they are attached by their threaded connection, as shown in FIG. 3. Upon doing so, the axial distance between the internal shoulder (26) of the upper tubular member (20), and the upper end of the lower tubular member (40) decreases, thereby axially compressing the tubular pack-off element (82) and the spring (88) between the internal shoulder (26) of the upper tubular member (20), and the upper end of the lower tubular member (40). On account of the Poisson effect, the outer sidewall (84) of the tubular pack-off element (82) radially expands against the inner sidewall that defines the lower portion (24) of the axial bore of the upper tubular member (20), while the inner sidewall (86) of the tubular pack-off element (82) radially contracts around the wireline (100). These effects may enhance the integrity of the seal formed by the tubular pack-off element (82) with the upper tubular member (20), and with the wireline. The cylindrical shape of the tubular pack-off element (82) may allow for a relatively uniform distribution of internal radial compressive stresses along the length of the tubular pack-off element (82), and along the length of the portion of the wireline surrounded by the tubular pack-off element (82).

In use, the assembled cable head (10) attaching the downhole tool to the wireline may be lowered into a wellbore, and used in an acid pump-down perforation operation to stimulate an oil and gas producing formation.

EXEMPLARY ASPECTS

In view of the described devices, systems, and methods and variations thereof, certain more particularly described aspects of the invention are presented below. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A cable head for attaching a wireline to a downhole tool, the cable head comprising:

(d) a upper tubular member and a lower tubular member removably attached by a threaded connection; and (e) a pack-off assembly disposed within the upper tubular member, and comprising:

(i) a deformable pack-off element comprising an outer sidewall for sealing against an inner sidewall of the upper tubular member, and an inner sidewall for sealing around the wireline; and (ii) a biasing means axially in line with the deformable tubular pack-off element;

wherein the tubular pack-off element and the spring are axially compressed between an internal shoulder of the upper tubular member and the lower tubular member when the upper and lower tubular members are removably attached by the threaded connection.

Aspect 2: The cable head of Aspect 1, wherein the pack-off element is made of an elastomeric material.

Aspect 3: The cable head of Aspect 1 or 2, wherein the pack-off element comprises a flat upper annular surface and a flat lower annular surface.

Aspect 4: The cable head of any one of Aspects 1 to 3, wherein the biasing means comprises a spring.

Aspect 5: The cable head of Aspect 4, wherein the spring is a coil spring.

Aspect 6: The cable head of any one Aspects 1 to 5, wherein the biasing means is disposed above the pack-off element.

Aspect 7: The cable head of any one of Aspects 1 to 6, wherein the pack-off assembly further comprises an upper annular bushing abutting an upper end of the tubular pack-off element, and a lower annular bushing abutting a lower end of the tubular pack-off element.

Aspect 8: A cable head for attaching a wireline to a downhole tool, the cable head comprising an upper member and a lower member removably attached; and a resilient pack-off disposed within the cable head, each defining an axial passage for the wireline, wherein the pack-off is disposed between the upper and lower members and seals against an interior surface of the upper member and an exterior surface of the wireline.

Aspect 9: The cable head of Aspect 8 further comprising a biasing means positioned within the upper tubular member for applying an axial force to the pack-off element.

Aspect 10: The cable head of Aspect 8 or 9, wherein the pack-off element is made of an elastomeric material.

Aspect 11: The cable head of any one of Aspects 8 to 10, wherein the pack-off element comprises a flat upper annular surface and a flat lower annular surface.

Aspect 12: The cable head of any one of Aspects 9 to 11, wherein the biasing means comprises a spring.

Aspect 13: The cable head of Aspect 12, wherein the spring is a coil spring.

Aspect 14: The cable head of any one Aspects 9 to 13, wherein the biasing means is disposed above the pack-off element.

Aspect 15: The cable head of any one of Aspects 8 to 14, wherein the pack-off further comprises an upper annular bushing abutting an upper end of the pack-off element, and a lower annular bushing abutting a lower end of the tubular pack-off element.

Aspect 16: The cable head of any one Aspects 1 to 15, comprising one, some or all of the features described or illustrated herein.

Aspect 16: A method of attaching a wireline to a downhole tool comprising the steps of:

(a) passing the wireline through a cable head;

(b) providing a seal around the wireline and to isolate an upper portion of the cable head from a lower portion of the cable head; and (c) attaching the wireline to an anchoring device disposed in the lower portion of the cable head.

Aspect 17: The method of Aspect 16 wherein the seal is provided by compressing a seal element axially to expand radially.

Aspect 18: The method of Aspect 16 or 17, utilizing one, some or all of the features of the cable head of any one of Aspects 1 to 15.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A method of attaching a wireline to a downhole tool comprising the steps of:

(a) passing the wireline through a cable head;

(b) providing a seal around the wireline and to isolate an upper portion of the cable head from a lower portion of the cable head; and (c) attaching the wireline to an anchoring device disposed in the lower portion of the cable head;

wherein the cable head comprises:

an upper tubular member and a lower tubular member removably attached by a threaded connection; and a pack-off assembly disposed within the upper tubular member, and comprising:

(i) a deformable pack-off element comprising an outer sidewall for sealing against an inner sidewall of the upper tubular member, and an inner sidewall for sealing around the wireline; and (ii) a spring axially in line with the deformable pack-off element; wherein the pack-off element and the spring are axially compressed between an internal shoulder of the upper tubular member and the lower tubular member when the upper and lower tubular members are removably attached by the threaded connection.

2. The method of claim 1 wherein the seal is provided by compressing a seal element axially to expand radially.

3. The method of claim 1, wherein the pack-off element is made of an elastomeric material.

4. The method of claim 1, wherein the pack-off element comprises a flat upper annular surface and a flat lower annular surface.

5. The method of claim 1, wherein the spring is a coil spring.

6. The method of claim 1, wherein the spring is disposed above the tubular pack-off element.

7. The method of claim 1, wherein the pack-off assembly further comprises an upper annular bushing abutting an upper end of the tubular pack-off element, and a lower annular bushing abutting a lower end of the tubular pack-off element.

* * * * *